US008297441B2

(12) United States Patent
Eugui

(10) Patent No.: US 8,297,441 B2
(45) Date of Patent: Oct. 30, 2012

(54) PROTECTIVE CONTACT STRIPS FOR BEVERAGE TRAYS

(75) Inventor: Cherie Eugui, Vahalla, NY (US)

(73) Assignee: Pepsico, Inc., Purchase, NY (US)

( * ) Notice: Subject to any disclaimer, the term of this patent is extended or adjusted under 35 U.S.C. 154(b) by 0 days.

(21) Appl. No.: 12/535,474

(22) Filed: Aug. 4, 2009

(65) Prior Publication Data

US 2011/0031147 A1 Feb. 10, 2011

(51) Int. Cl.
*B65D 65/00* (2006.01)

(52) U.S. Cl. ..... 206/427; 206/521; 206/521.6; 206/505; 220/509; 211/74; 211/71.01

(58) Field of Classification Search ..... 206/508, 206/427, 509; 220/516, 509; 211/74, 71.01
See application file for complete search history.

(56) References Cited

U.S. PATENT DOCUMENTS

| | | | | |
|---|---|---|---|---|
| 4,880,119 | A | 11/1989 | Simon | |
| 4,997,090 | A | 3/1991 | Lenmark, Sr. et al. | |
| 5,148,919 | A | 9/1992 | Rubin | |
| 5,175,058 | A | 12/1992 | Traver | |
| 5,200,263 | A | 4/1993 | Gould et al. | |
| 5,297,767 | A | 3/1994 | Miller et al. | |
| 5,310,787 | A | 5/1994 | Kutsuwa et al. | |
| 5,509,633 | A | 4/1996 | Ruster et al. | |
| 5,593,395 | A | 1/1997 | Martz | |
| 5,657,865 | A | 8/1997 | Harrelson | |
| 5,839,711 | A | 11/1998 | Bieck et al. | |
| 5,897,090 | A | 4/1999 | Smith et al. | |
| 6,012,583 | A * | 1/2000 | Ramirez | 206/521.1 |
| 6,131,730 | A * | 10/2000 | Hsu | 206/203 |
| 6,170,787 | B1 | 1/2001 | Morgan | |
| 6,502,711 | B1 * | 1/2003 | Mc Rae | 220/23.4 |
| 6,732,894 | B2 | 5/2004 | Hubbert et al. | |
| 7,152,736 | B1 | 12/2006 | Menichini | |
| 7,278,906 | B2 | 10/2007 | Kawase et al. | |
| 7,281,641 | B2 * | 10/2007 | Apps | 220/516 |
| 7,413,154 | B2 | 8/2008 | Harshman et al. | |
| 7,413,244 | B2 | 8/2008 | Tanaka et al. | |
| 2007/0075077 | A1 * | 4/2007 | Dubois et al. | 220/1.5 |
| 2008/0105584 | A1 | 5/2008 | Cecil | |
| 2009/0117236 | A1 * | 5/2009 | Watzke | 426/106 |
| 2009/0206088 | A1 * | 8/2009 | Ogburn | 220/516 |

OTHER PUBLICATIONS

Office Action from Canadian Application No. 2,709,250, mailed Oct. 31, 2011.

* cited by examiner

*Primary Examiner* — David T. Fidei
*Assistant Examiner* — Raven Collins
(74) *Attorney, Agent, or Firm* — Banner & Witcoff, Ltd.

(57) ABSTRACT

A method and an apparatus for protecting the surfaces and labels of beverage containers are disclosed. The invention includes a beverage tray having a floor and walls extending from the floor. The beverage tray includes a plurality of dividing sections that divide the beverage tray into beverage sections. Each beverage section may hold a single beverage container. The beverage tray may include a plurality of contact strips positioned within the beverage tray and configured to contact the surface of the beverage container. The contact strips may be placed on the walls of the beverage tray or on the dividing sections of the beverage tray. The contact strips may be applied to existing beverage trays to protect the surfaces and labels of beverage bottles from being damaged by the surface of the beverage trays.

13 Claims, 4 Drawing Sheets

PROTECTIVE CONTACT STRIPS FOR BEVERAGE TRAYS

FIELD OF THE INVENTION

This invention relates generally to protective contact strips for beverage shells, and more particularly to protective contact strips affixed to beverage shells such that the protective contact strips protect the surface and labels on beverage containers from abrasion.

BACKGROUND

The beverage industry utilizes high-density polyethylene (HDPE) trays or "shells" for the distribution of beverages. The trays can have a life span of up to 10 years. Filled beverage containers are placed in the trays by beverage packing equipment. The trays may be put on pallets and the filled beverage containers may be stored in a warehouse environment until distribution. The filled beverage containers may be transported in the beverage trays to stores via a combination of large trucks, small route sales trucks, hand trucks, and hand carrying of the trays to a store shelf. Additionally, the beverage containers may be merchandised within the trays.

When the beverage containers are removed from the trays, the trays are transported back to the manufacturing site and generally stored outside. While outside, the beverage trays are exposed to environmental elements, such as snow, rain, and extreme temperatures. When the trays are needed for use, the trays are brought into the manufacturing plant, washed at a high temperature, and reused. Exposure to the environment and normal wear and tear during use create small scratch like imperfections in the HDPE surfaces of the beverage trays. These imperfections subsequently contact the label and surface of the beverage containers within the tray and may cause visually observable damage and abrasions to the surface of the beverage containers and labels affixed on the containers. The damage to the beverage containers and labels may be exacerbated by vibrations to which the beverage containers are subjected. Accordingly, there is a need to protect the labels and surfaces of beverage containers from damage caused by imperfections in the beverage trays.

SUMMARY OF THE INVENTION

The invention addresses the above mentioned needs by providing a protective contact strip to prevent damage and abrasions to the label and surface of a beverage container. One aspect of the present invention is directed to a beverage tray having a floor and walls extending upward from the floor. The beverage tray may include a plurality of dividing sections that divide the beverage tray into a plurality of beverage sections. Each of the beverage sections may be configured to receive one beverage container. The beverage tray may further include a plurality of contact strips, which are configured to contact a beverage container. The contact strips may be positioned on the walls of the beverage container and the dividing sections.

Another aspect of the invention is directed to a method for protecting beverage containers when the beverage containers are being stored or transported in a beverage tray. The method may include affixing a plurality of contact strips to a plurality of side walls of a beverage tray. The method may also include affixing a plurality of contact strips to a plurality of end walls of the beverage tray. The method may further include affixing a plurality of contact strips to a plurality of dividing members in the beverage tray. The plurality of dividing members may be arranged to form a plurality of beverage sections and each beverage section may be configured to hold a beverage container. The contact strips may be configured to contact a surface of a beverage container.

Other features and advantages of the invention will become apparent to those skilled in the art upon review of the following detailed description, claims and drawings in which like numerals are used to designate like features.

Figure 1:
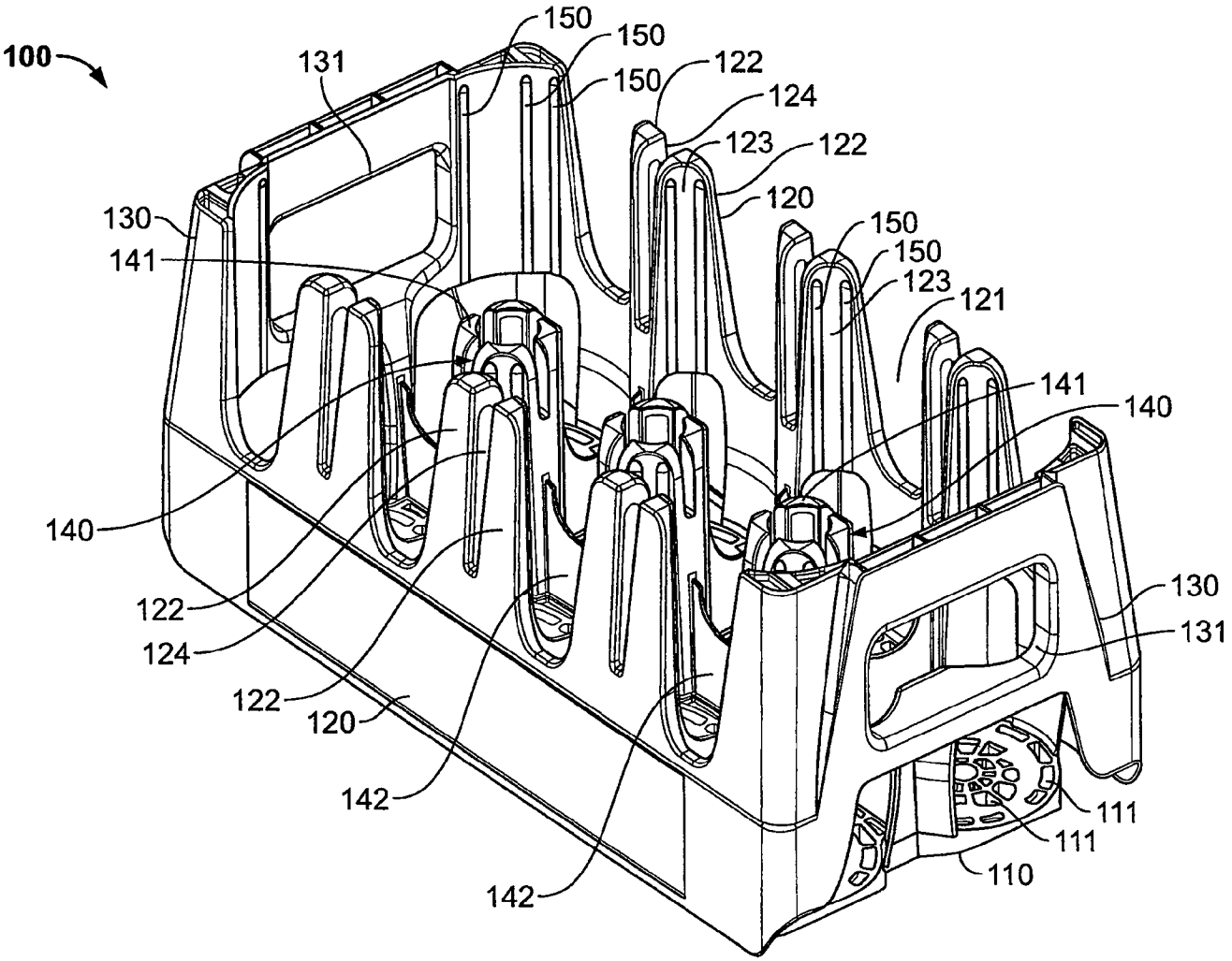
FIG. 1 illustrates a perspective view of exemplary embodiment of a beverage tray having protective contact strips.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

The invention may be embodied in many forms. FIG. 1 illustrates a perspective view of a beverage tray 100 having a plurality of contact strips 150 for protecting the labels and outer surfaces of beverage containers that may be carried or stored in the beverage tray 100. The beverage tray 100 may be made out of any suitable material for storing and transporting beverage containers. In at least one embodiment, the beverage tray 100 is made from high-density polyethylene (HDPE). The beverage tray 100 may be configured to hold any size of beverage container. For example, the beverage tray 100 may be configured to hold 16 oz. bottles, 20 oz. bottles, 1-Liter or 2-Liter bottles. The beverage tray 100 may include a floor 110. In one embodiment, the floor 110 may be generally rectangular and include two sides and two ends. Alternatively, the floor 110 may be any other suitable shape such as a square, circle, etc. The floor 110 may be of solid construction or may include any number of openings or apertures 111. The openings or apertures 111 may be of any suitable shape or size or combination of shapes or sizes, such that the apertures 111 are configured to allow air to flow through the apertures 111 or to allow liquid, such as a spilled beverage, to drain through the apertures 111 rather than pooling within the beverage tray 100.

The beverage tray 100 may include walls extending from the floor 110. In one embodiment, the beverage tray 100 may include two side walls 120 and two end walls 130 extending upward from the floor 110. The side walls 120 and end walls 130 may be connected to each other. Alternatively, the side walls 120 and end walls 130 may be a unitary construction. In at least one embodiment, the corners of the beverage tray 100 where the side walls 120 and the end walls 130 connect are curved, such that the curve of the corners cooperate with the contour of a beverage container.

In at least one embodiment, each end wall 130 includes an opening 131, which may function as a handle and allow a person to grasp each end wall 130 to hold or transport the beverage tray 100. Alternatively, the side walls 120 may include openings that function as handles. In a further embodiment, two opposing walls, such as the side walls 120 or the end walls 130 may each include a handle extending outwardly from the surface of the walls for holding and transporting the beverage tray 100.

Figure 2:
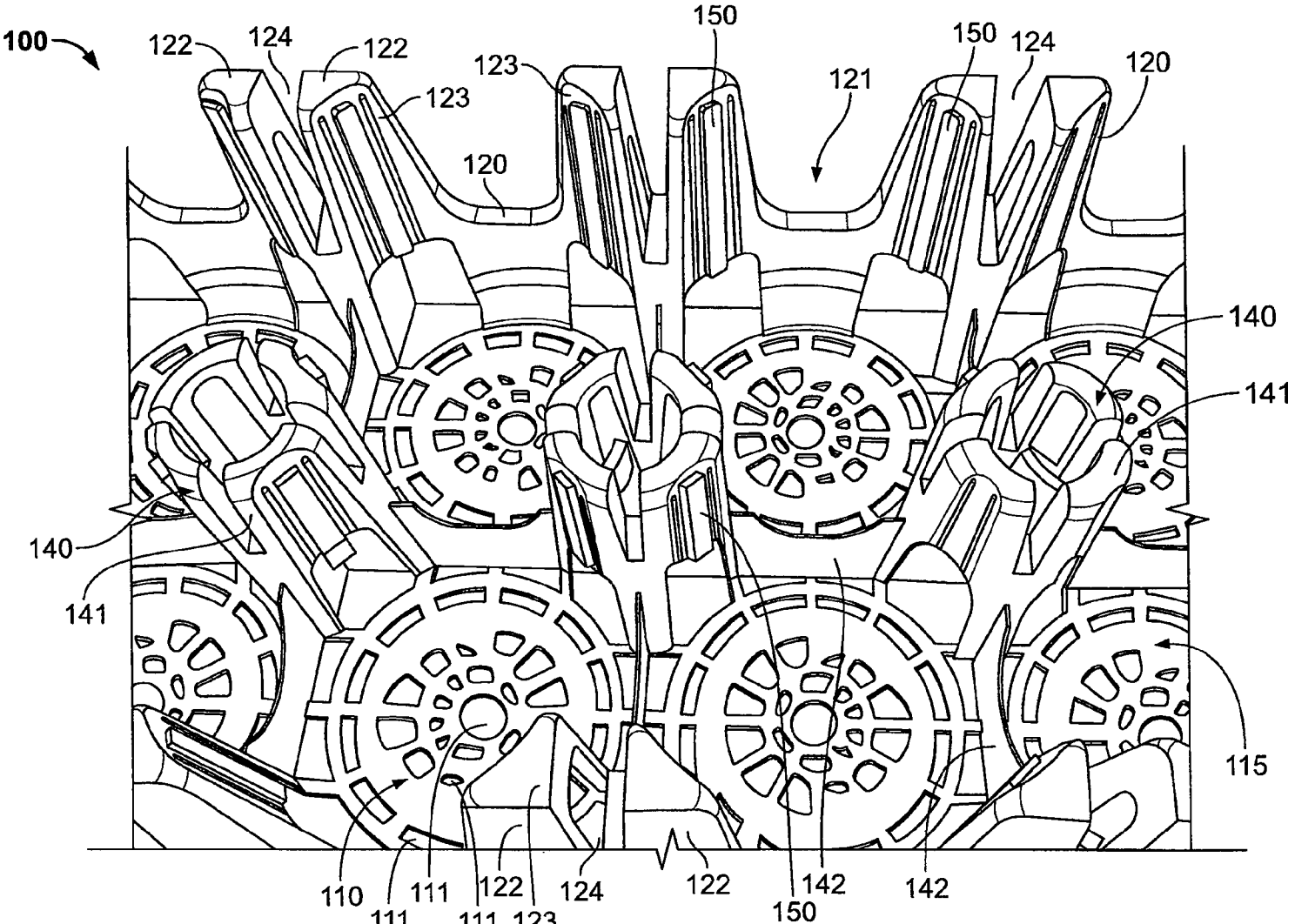
FIG. 2 illustrates an isometric top view of the exemplary embodiment of the beverage tray having protective contact strips.
Figure 3:
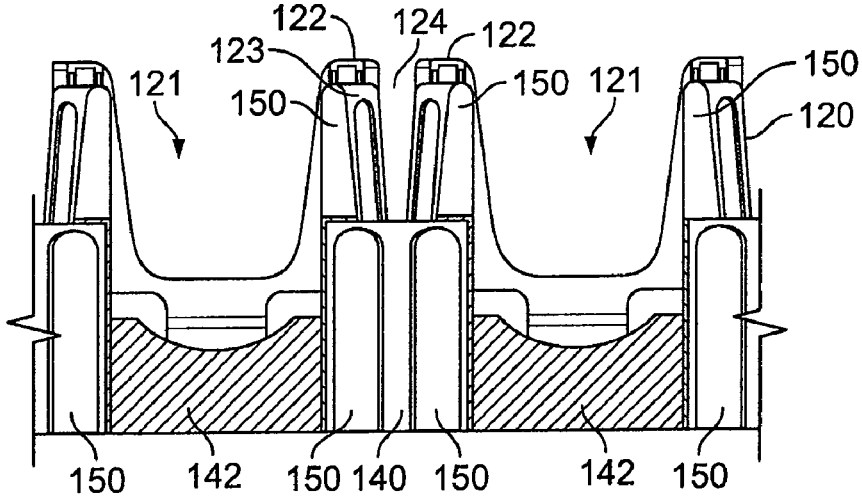
FIG. 3 illustrates a side view of a section of the exemplary embodiment of the beverage tray illustrating the dividing sections and protective contact strips.

As illustrated in FIGS. 1 and 2, the two side walls 120 may include a plurality of apertures 121. The apertures 121 may be of any shape or size. For example, in at least one embodiment, some of the apertures 121 may be U-shaped. In this embodiment, the top of the U-shaped aperture 121 is positioned at the top of each side wall 120 and the bottom or curved portion of the U-shape extends toward the floor 110. In this embodiment, the portions 122 of the side wall 120 may extend upward adjacent the U-shaped aperture 121 and may be contoured and curved towards the inside of the beverage tray 100 to cooperate with the curved shape of a beverage container. Additionally, the side walls 120 may include apertures 124, as illustrated in FIGS. 1-3, which are located between portions 122. The apertures 124 may be any shape or size. In one embodiment, as best illustrated in FIGS. 2 and 3, the apertures 124 may be generally V-shaped. In at least one embodiment, the side walls 120 may include a plurality of protrusions 123 that extend inwardly towards the inside of the beverage tray 100. In this embodiment, the protrusions 123 may be located on portions 122 and the protrusions 123 may have a curvature that corresponds to the curvature of a beverage container.

As illustrated in FIG. 2, the beverage tray 100 may include a plurality of dividing sections 140 that extend upward from the surface of the floor 110 and divide the floor into a plurality of beverage sections 115. Each of the beverage sections 115 may be configured to hold one beverage container. The number of dividing sections 140 may vary depending on the size of the beverage containers or the size of the beverage tray 100. The dividing sections 140 may be arranged in any configuration, such as rows extending along the length of the beverage tray 100 between each of the end walls 130. In the embodiment illustrated in FIG. 1, three dividing sections 140 are arranged in a single row along the center of the floor to create eight beverage sections 115 within the beverage tray 100.

FIG. 3 illustrates a side view of the dividing sections 140 within the beverage tray 100. The dividing sections 140 may be a solid shape or may be formed by a plurality of dividing members 141. In one embodiment as illustrated in FIG. 3, four dividing members 141 may be arranged in a circular shape to form each dividing section 140. In this embodiment, each one of the four dividing members 141 is positioned in a separate beverage section 115. The beverage tray 100 may further include dividing walls 142 that extend between each of the dividing sections 140. Additionally, the beverage tray 100 may include dividing walls 142 that extend between a side wall 120 and a dividing section 140 or an end wall 130 and a dividing section 140.

Figure 4:
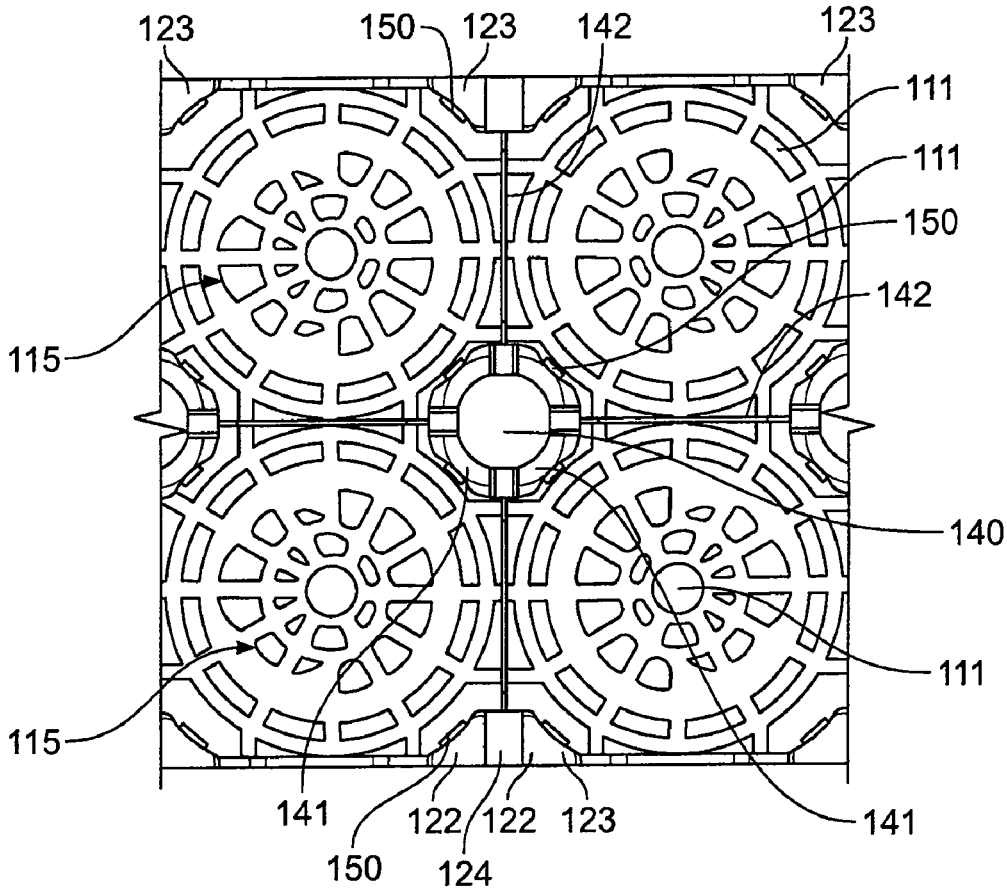
FIG. 4 illustrates a top view of section of the exemplary beverage tray having protective contact strips and illustrating a plurality of beverage sections.

FIG. 4 illustrates the top of the beverage tray 100 and the beverage sections 115. Each beverage section 115 may be formed by one or more of the following: dividing walls 142, a side wall 120, an end wall 130, and a dividing section 140. For example, a beverage section 115 located in the corner of the beverage tray 100 may be formed by a portion of the end wall 130, a portion of a side wall 120, a portion of the dividing section 140, and two dividing walls 142 (one dividing wall 142 extending from the side wall 120 to the dividing section 140 and one dividing wall 142 extending from the dividing section 140 to the end wall 130). In another example, a beverage section 115 may be defined by a portion of four dividing sections 140 and four dividing walls 142 extending between each of the dividing sections 140.

Referring back to FIG. 2, the beverage tray 100 may further include a plurality of contact strips 150 that protect the label and surface of a beverage container. The contact strips 150 may protect beverage containers stored or transported in the beverage trays 100 by preventing scratches on the surface of the beverage trays 100 from damaging either the label or the surface of a beverage container. The contact strips 150 may be placed on any portion of the beverage tray 100 that contacts a beverage container when the beverage container is in the beverage tray 100. In at least one embodiment, at least one contact strip 150 is arranged on each contoured section of the side walls 120, such as the protrusions 123. Additionally, at least four contact strips 150 are arranged on each dividing sections 140, such that at least one contact strip 150 is arranged in each beverage section 115. Alternatively, a plurality of contact strips 150 may be positioned on each protrusion 123 and a plurality of contact strips 150 may be positioned on the portion of the dividing section 140 within each beverage section 115. Additionally, if the dividing sections 140 include dividing members 141, each of the dividing members 141 may have at least one contact strip 150.

The contact strips 150 may be affixed to the dividing sections and beverage tray 100 in any suitable manner. For example, the contact strips 150 may have an adhesive that allows the contact strip 150 to be placed on existing beverage trays 100. Alternatively, the contact strips 150 could be affixed to a beverage tray 100 during manufacture. In at least one embodiment, the contact strips 150 are permanently affixed or secured to the beverage tray 100.

Figure 5:
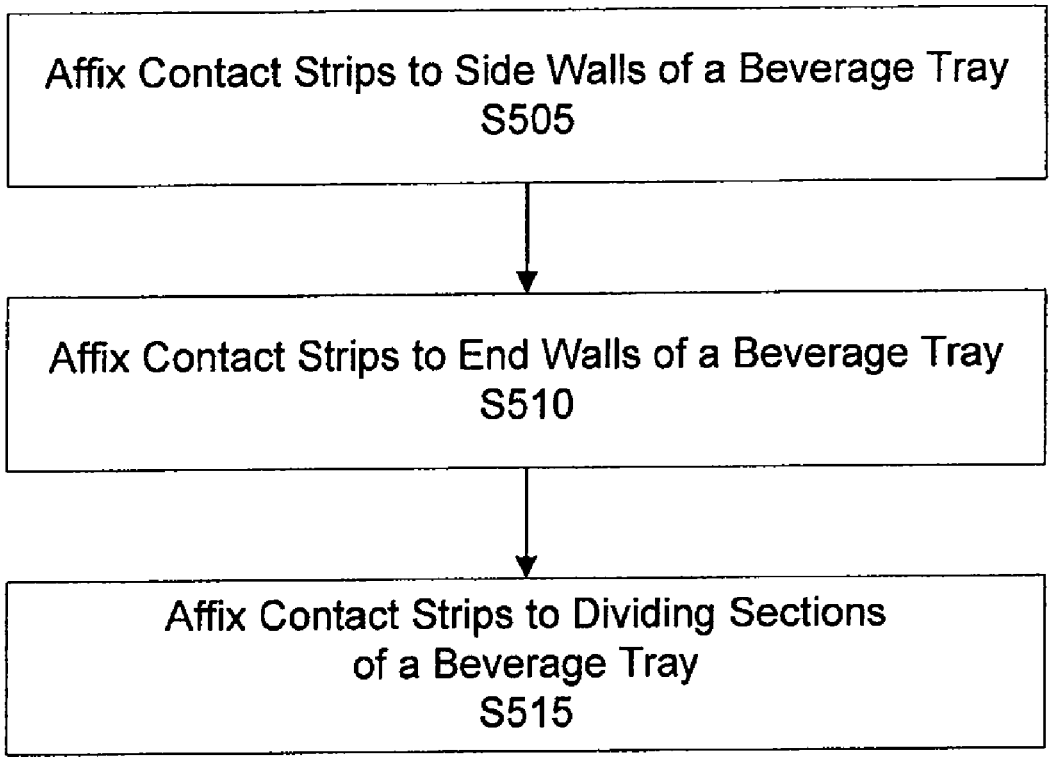
FIG. 5 illustrates an exemplary method of protecting a beverage container using embodiments of the invention illustrated in FIGS. 1-4.

FIG. 5 illustrates a method of protecting a beverage container. In S505, a plurality of contact strips 150 are affixed to a plurality of side walls 120 of a beverage tray 100. The beverage tray 100 may be configured to accommodate a plurality of beverage containers. In S510, a plurality of contact strips 150 are affixed to a plurality of end walls 130 of the beverage tray 100. In S515, a plurality of contact strips 150 are affixed to a plurality of dividing sections 140. The plurality of dividing sections 140 may be configured to divide the beverage tray 100 into a plurality of beverage sections 115. The plurality of dividing sections 140 may include a plurality of dividing members 141, which are arranged to form each of the dividing sections 140. The plurality of contact strips 150 may be permanently affixed or secured to the side walls 120, the end walls 130, and the dividing sections 140 of the beverage tray 100. Each of the contact strips 150 affixed to the beverage tray 150 may be configured to contact a surface of a beverage container or a label on a beverage container in order to protect the surface and label of the beverage containers within the beverage tray 100. In this method, the plurality of contact strips 150 may be affixed to the beverage tray 100 in any manner, such as an adhesive.

The contact strips 150 may be manufactured to tolerate environmental extremes, such as the high and low temperatures, snow, rain, and dry conditions experienced when the beverage trays 100 are stored outside. Additionally, the contact strips 150 may be manufactured to withstand high temperature washing processes in excess of 200 F. The contact strips 150 may also be able to withstand chemical cleaning agents and lubrications commonly used during beverage processing. The contact strips 150 may be made of any suitable material that meets the guidelines and requirements for indirect food contact applications. In one embodiment, the contact strips 150 are made of small cross-linked closed cell polyethylene.

The beverage trays 100 may be configured to allow stacking of the beverage trays 100. In at least one embodiment, at least twenty beverage trays 100 may be upon each other without damaging the beverage trays 100 or the contact strips 150.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A beverage tray for holding and transporting beverage containers comprising:

a floor;

two side walls, each side wall extending from the floor and opposing the other side wall wherein the two side walls include a plurality of U-shaped apertures;

a plurality of protrusions, each of the plurality of protrusions comprising a raised surface extending from a given side wall surface, the raised surface facing inwardly toward the inside of the beverage tray;

two end walls, each end wall extending from the floor and opposing the other end wall;

a plurality of dividing members extending from the floor, the plurality of dividing members configured to contact a beverage container, the plurality of dividing members dividing the floor into a plurality of beverage sections;

a plurality of protective contact strips affixed to the dividing members and the plurality of protrusions using an adhesive, the plurality of protective contact strips being positioned on the dividing members and the plurality of protrusions to contact a beverage container to prevent damage and abrasions to the beverage container wherein the plurality of protective contact strips are configured to withstand high temperature washing processes in excess of 200 degrees Fahrenheit and wherein the plurality of protective contact strips are made of small cross-linked closed cell polyethylene, wherein the plurality of protrusions are configured to facilitate enhanced contact between the beverage container and the plurality of protective contact strips, wherein each of the plurality of beverage sections is configured to receive one beverage container.

2. The beverage tray of claim 1, wherein the floor defines a plurality of openings.

3. The beverage tray of claim 1, wherein the plurality of protective contact strips are resistant to chemicals and lubrications.

4. The beverage tray of claim 1, wherein each of the end walls includes an opening that functions as a handle for the beverage tray.

5. A beverage tray for holding and transporting beverage containers comprising:

a floor;

a plurality of walls extending from the floors, the plurality of walls including side walls and end walls, wherein the side walls include a plurality of U-shaped apertures;

a plurality of protrusions, each of the plurality of protrusions comprising a raised surface extending from a given side wall surface, the raised surface facing inwardly toward the inside of the beverage tray;

a plurality of dividing sections extending from the floor and dividing the beverage tray into a plurality of beverage sections; and a plurality of protective contact strips affixed to the plurality of end walls, the plurality of dividing sections, and the plurality of protrusions using an adhesive wherein the plurality of protective contact strips are made of small cross-linked closed cell polyethylene, wherein the plurality of protective contact strips are configured to contact the surface of a beverage container within the beverage sections to prevent damage and abrasions to the beverage container and wherein the plurality of protective contact strips are further configured to withstand high temperature washing processes in excess of 200 degrees Fahrenheit, wherein the plurality of protrusions are configured to facilitate enhanced contact between the beverage container and the plurality of protective contact strips.

6. The beverage tray of claim 5, wherein each of the plurality of dividing sections includes a plurality of dividing members, each of the dividing members including at least one protective contact strip configured to contact a beverage container.

7. The beverage tray of claim 6, wherein the plurality of dividing members are arranged in a circular shape to form each of the plurality of dividing sections.

8. The beverage tray of claim 5, wherein the beverage tray is configured to hold 20 oz beverage containers.

9. The beverage tray of claim 5, wherein the beverage tray is configured to hold 1 Liter beverage containers.

10. The beverage tray of claim 5, further comprising:

a dividing wall extending between each of the plurality of dividing sections.

11. The beverage tray of claim 10, wherein the dividing wall connects each of the plurality of dividing sections to one of the side walls or end walls.

12. The beverage tray of claim 5, wherein each beverage section is defined by at least one side wall or end wall and a plurality of dividing walls.

13. A method for protecting a beverage container comprising:

using an adhesive, affixing a plurality of protective contact strips to a plurality of protrusions within a beverage tray, the beverage tray further comprising a floor, a plurality of end walls, and a plurality of side walls, the beverage tray configured to hold and transport a plurality of beverage containers, wherein each of the plurality of protrusions comprise a raised surface extending from a given sidewall surface, the raised surface facing inwardly toward the inside of the beverage tray, wherein the plurality of protrusions are configured to facilitate enhanced contact between the plurality of beverage containers and the plurality of protective contact strips;

affixing a plurality of protective contact strips to the plurality of end walls of the beverage tray using the adhesive;

affixing a plurality of protective contact strips to a plurality of dividing members in the beverage tray using the adhesive, the plurality of dividing members dividing the beverage tray into a plurality of beverage sections, each beverage section configured to hold a beverage container, wherein each of the plurality of protective contact strips is configured to contact a surface of a beverage container to prevent damage and abrasions to the beverage container, wherein each of the plurality of protective contact strips is further configured to withstand high temperature washing processes in excess of 200 degrees Fahrenheit, and wherein the plurality of protective contact strips are made of small cross-linked closed cell polyethylene.

* * * * *